US005505799A

United States Patent [19]

Makowiecki

[11] Patent Number: 5,505,799

[45] Date of Patent: Apr. 9, 1996

[54] NANOENGINEERED EXPLOSIVES

[75] Inventor: Daniel M. Makowiecki, Livermore, Calif.

[73] Assignee: Regents of the University of California, Oakland, Calif.

[21] Appl. No.: 120,407

[22] Filed: Sep. 19, 1993

[51] Int. Cl.[6] ..... C06B 45/14; C06B 33/00

[52] U.S. Cl. ..... 149/15; 149/37

[58] Field of Search ..... 149/15, 37

[56] References Cited

U.S. PATENT DOCUMENTS

| | | | |
|---|---|---|---|
| 3,118,275 | 1/1964 | McLain | 60/35.4 |
| 3,159,104 | 12/1964 | Hodgson | 102/98 |
| 3,163,113 | 12/1964 | Davis et al. | 102/98 |
| 3,503,814 | 3/1970 | Helms, Jr. et al. | 149/109 |
| 3,523,839 | 8/1970 | Shechter et al. | 149/7 |
| 3,549,436 | 12/1970 | LaRocca | 149/15 |
| 3,995,559 | 12/1976 | Bice et al. | 149/15 X |
| 4,432,818 | 2/1984 | Givens | 149/22 |
| 4,464,989 | 8/1984 | Gibson et al. | 102/202 |
| 4,715,280 | 12/1987 | Wittwer | 102/202.8 |
| 4,824,495 | 4/1989 | Verneker | 149/7 |
| 4,976,200 | 12/1990 | Benson et al. | 102/202.7 |
| 5,090,322 | 2/1992 | Allford | 102/202.7 |
| 5,266,132 | 11/1993 | Danen et al. | 149/15 |

FOREIGN PATENT DOCUMENTS

| | | | |
|---|---|---|---|
| 737937 | 2/1970 | Belgium | 149/2 |
| 524032 | 4/1956 | Canada | 149/15 |
| 2046663 | 3/1972 | Germany | 149/2 |
| 46-26119 | 7/1971 | Japan | 149/15 |
| 14750 | of 1904 | United Kingdom | 149/15 |

*Primary Examiner*—Peter A. Nelson
*Attorney, Agent, or Firm*—Henry P. Sartorio; L. E. Carnahan

[57] ABSTRACT

A complex modulated structure of reactive elements that have the capability of considerably more heat than organic explosives while generating a working fluid or gas. The explosive and method of fabricating same involves a plurality of very thin, stacked, multilayer structures, each composed of reactive components, such as aluminum, separated from a less reactive element, such as copper oxide, by a separator material, such as carbon. The separator material not only separates the reactive materials, but it reacts therewith when detonated to generate higher temperatures. The various layers of material, thickness of 10 to 10,000 angstroms, can be deposited by magnetron sputter deposition. The explosive detonates and combusts a high velocity generating a gas, such as CO, and high temperatures.

28 Claims, 2 Drawing Sheets

NANOENGINEERED EXPLOSIVES

The United States Government has rights in this invention pursuant to Contract No. W-7405-ENG-48 between the United States Department of Energy and the University of California for the operation of Lawrence Livermore National Laboratory.

BACKGROUND OF THE INVENTION

The present invention relates to heat generating material, particularly to reactive elements and molecules for generating a working fluid, and more particularly to a nanoengineered propellant or explosive and method of fabricating same from reactive inorganic components separated by an organic component, such as carbon, which upon detonation reacts with the inorganic components to generate higher temperatures, and produce a working fluid.

Organic explosives are well known and consist of atoms of carbon (c), hydrogen (H), oxygen (O), and nitrogen (N), for example, that react at very high velocities generating considerable heat and expanding gases capable of producing work. Also known are explosives composed of inorganic elements, such as titanium and aluminum, which react with oxygen, carbon, or nitrogen and produce more energy than organic explosives or reactions, but do not generate a working gas. Also, reacting atoms of the inorganic components are not in intimate contact as in organic explosive molecules, and therefore the explosive reaction velocities of the organic explosives are not achieved.

Thus, there is a need in the art for an explosive which has the capability of producing heat and expanding gases capable of producing work, as in explosives and propellants using organic components, while having the energy producing capability of explosives using inorganic components. Such a need is satisfied by the present invention which uses thin multilayer structures composed of an organic component, such as carbon, for separating reactive inorganic components, and which reacts or detonates to generate higher temperatures and produce a working fluid. By way of example, a multilayer structure may be composed of a plurality of alternating thin (≧10 Å) layers titanium (Ti) and copper oxide (CuO) with thin (≧10 Å) layers of carbon (C) between the layers of Ti and CuO, the layers being deposited by vapor deposition techniques.

SUMMARY OF THE INVENTION

It is an object of this invention to provide a nanoengineered propellant or explosive composed of submicron alternating layers of inorganic and an organic material, such as carbon.

A further object of the invention is to provide a method for fabricating a thin multilayer structure which has the advantage of both organic and inorganic explosives.

Another object of the invention is to provide a thin multilayer structure of reactive elements and oxides that have the capability of producing more heat than organic explosives and generating a working fluid.

Another object of the invention is to provide a fabrication method that allows potentially reactive elements to be separated by less reactive elements thus preserving their reactivity until some form of detonation produces a high velocity combustion reaction.

Another object of the invention is to provide a multilayer explosive composed of submicron layers of a reactive metal, such as titanium (Ti), and submicron layers of an inorganic oxide, such as copper oxide (CuO), separated by submicron layers of an organic material, such as carbon (C).

Other objects and advantages will become apparent from the following description and accompanying drawings. Basically, the invention comprises a thin multilayer structure and method of fabrication, wherein the structure includes alternating thin (≧10 Å) layers of an inorganic element, such as titanium, an inorganic oxide, such as copper oxide, with a thin (≧10 Å) layer of an organic material, such as carbon, between each of the layers. The organic material layer as the separating material prevents any passivating reaction between the reactive metal layer and the inorganic oxide layer prior to detonation, and upon detonation reacts with the inorganic materials to generate high temperatures and produce a working fluid, such as carbon monoxide (CO). The thin layers may be deposited by vapor deposition techniques, such as by magnetron sputter deposition.

BRIEF DESCRIPTION OF THE DRAWINGS

The accompanying drawings, which are incorporated into and form a part of the disclosure, illustrates an embodiment of the invention and a magnetron source arrangement for producing the invention, and together with the description, serves to explain the principles of the invention.

DETAILED DESCRIPTION OF THE INVENTION

The present invention involves a new type of explosive wherein the intimate arrangement of reactive elements in an organic explosive molecule is imitated by the modulation of atomically thick layers of inorganic components that have great heat of reaction and generate a gas. Further, the invention involves the fabrication of very thin multilayer structures by vapor deposition techniques, referred to as "nanoengineering", to produce a complex modulated structure of reactive elements that have the capability of considerably more heat than organic explosives while generating a working fluid (gas). The fabrication method allows potentially reactive elements to be separated by less reactive elements thus preserving their reactivity until some form of detonation produces a high velocity combustion reaction. An example of the reactive materials is titanium (Ti) and copper oxide (CuO), with the element carbon (C) being the separating material that prevents any passivating reaction prior to detonation. The use of carbon, for example, is an important feature of this invention, since the carbon not only separates the reactive materials, but it reacts with many inorganic elements to form carbides and generate high temperatures in the process. At high temperatures, ~2000° C., some carbides will react with non-refractory oxides to produce carbon monoxide (CO) as a gas and a more stable oxide. Thus, a multilayer structure of this invention may use the submicron layer combinations: titanium-carbon-copper oxide (Ti—C—CuO), beryllium-carbon-copper oxide (Be—C—CuO), and aluminum-carbon-copper oxide (Al—C—CuO), for example. Other oxides-metals combinations which will react in a similar way may be utilized.

Fabrication of the very thin submicron (≧10 Å) layers of the multilayer structure of this invention is carried out by vapor deposition techniques, such as by magnetron sputter deposition. Multilayered structures or nanoengineered material have been fabricated using the magnetron sputter deposition technique, and layers of less than 10 angstroms thick have been successfully produced.

The addition of carbon to the multilayer structure of these materials serves to produce a greater volume of combustion gases. Also, the intimate submicron layers of carbon, reactive metals, and inorganic oxides is a considerably more reactive material than a mixture of powders of these same components, and it is observed that nanomultilayered structures will react at least four orders of magnitude faster than powder mixtures, although experimental verification has not been completed on various materials for the metal-carbon-oxide multilayer structure of this invention.

Figure 1:
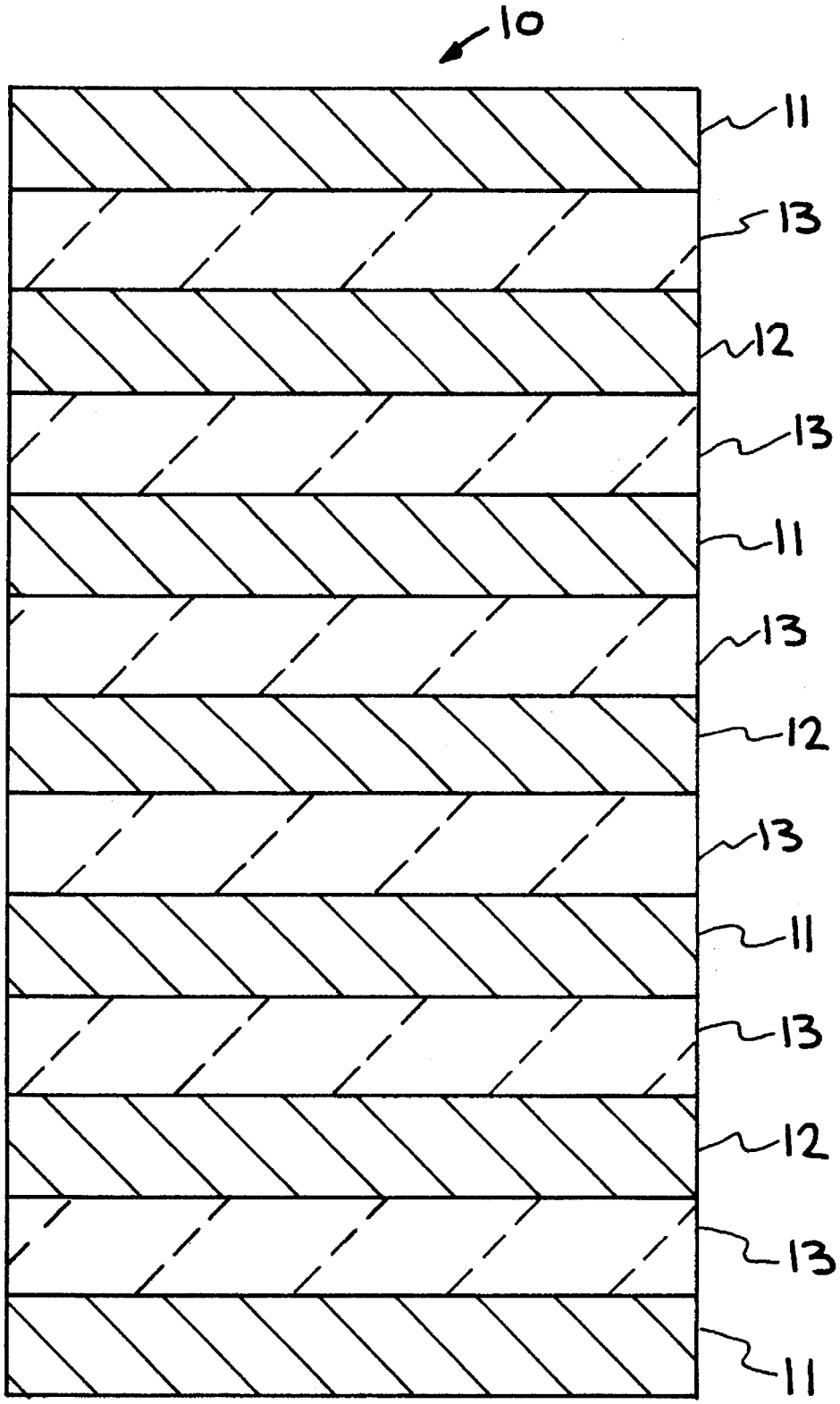
FIG. 1 is a greatly enlarged cross-sectional view of an embodiment of a nanoengineered explosive in accordance with the present invention.

FIG. 1 illustrates a multilayer structure using a sequence of Ti—C—CuO layers, that prevents unwanted passivation reactions and will detonate and combust at high velocities generating carbon monoxide (CO) and high temperatures. The embodiment illustrated comprises a multilayer structure 10 of repeated submicron layers of titanium (Ti) and copper oxide (CuO), indicated at 11 and 12, with a submicron layer 13 of carbon (C) between each of the Ti and CuO layers, each of layers 11, 12 and 13 having a thickness between 10 angstroms and one micrometer (1000 Å). Note that the outer layer at each end of the multilayer structure is titanium so as to reduce the reactive effects with the surrounding atmosphere.

The reaction of metals (i.e. Al, Ti, Be . . . ) with inorganic oxides (i.e. CuO, $Fe_2O_3$, $MnO_2$ . . . ) is well known. For example, the reaction of Al and $Fe_2O_3$ to produce $Al_2O_3$ and Fe is referred to as the Thermite reaction, and it has been used for many years in metallurgical processes, such as welding.

Also, the enhanced reactivity of thin multilayer structures compared to powder mixtures has been observed by other researchers. The reactivity of thin multilayer structures is attributed to the energy stored in the layer interfaces and the very high ratio of interface area to volume.

However, the following three features of this nanoengineered explosive make unique and novel:

1. The use of carbon layers to prevent a passivating reaction between the metal and the oxide layers. Thus, the sequence of layers is unique.
2. The reaction sequence is a unique and essential part of this invention. The metals used in the nanoengineered explosive all react with carbon to form a carbide with the generation of considerable heat. This raises the temperature of the structure and results in a self-sustaining reaction:

$$\text{metal(M)+carbon(C)} \rightarrow \text{MC+heat}$$

3. The inorganic oxides used are not thermodynamically stable. They can be easily reduced by reaction with carbon and carbide at high temperatures about 2000° C. Therefore, as the multilayer structure is heated by the carbide reaction the carbon/carbide layer will react with the oxide layer to produce a gas, such as CO:

$$\text{C+MO} \rightarrow \text{CO+M}$$

Also, the carbides formed in the first reaction will react with the inorganic oxides to produce a gas, such as CO, pure metal from the oxide, and a more stable oxide from the metal in the carbide, for example:

$$\text{Al+C} \rightarrow \text{Al}_4\text{C}_3\text{+CuO} \rightarrow \text{Al}_2\text{O}_3\text{+Cu+CO}$$

Thus, it is seen that the carbon layers and the sequence of layers in the multilayer structure are the essential components of this invention. The metals and inorganic oxides, exemplified as the reactants are known. The enhanced reactivity of thin multilayer structures is also known. However, the nanoengineered explosive of this invention is the result of combining these known technologies.

Figure 2:
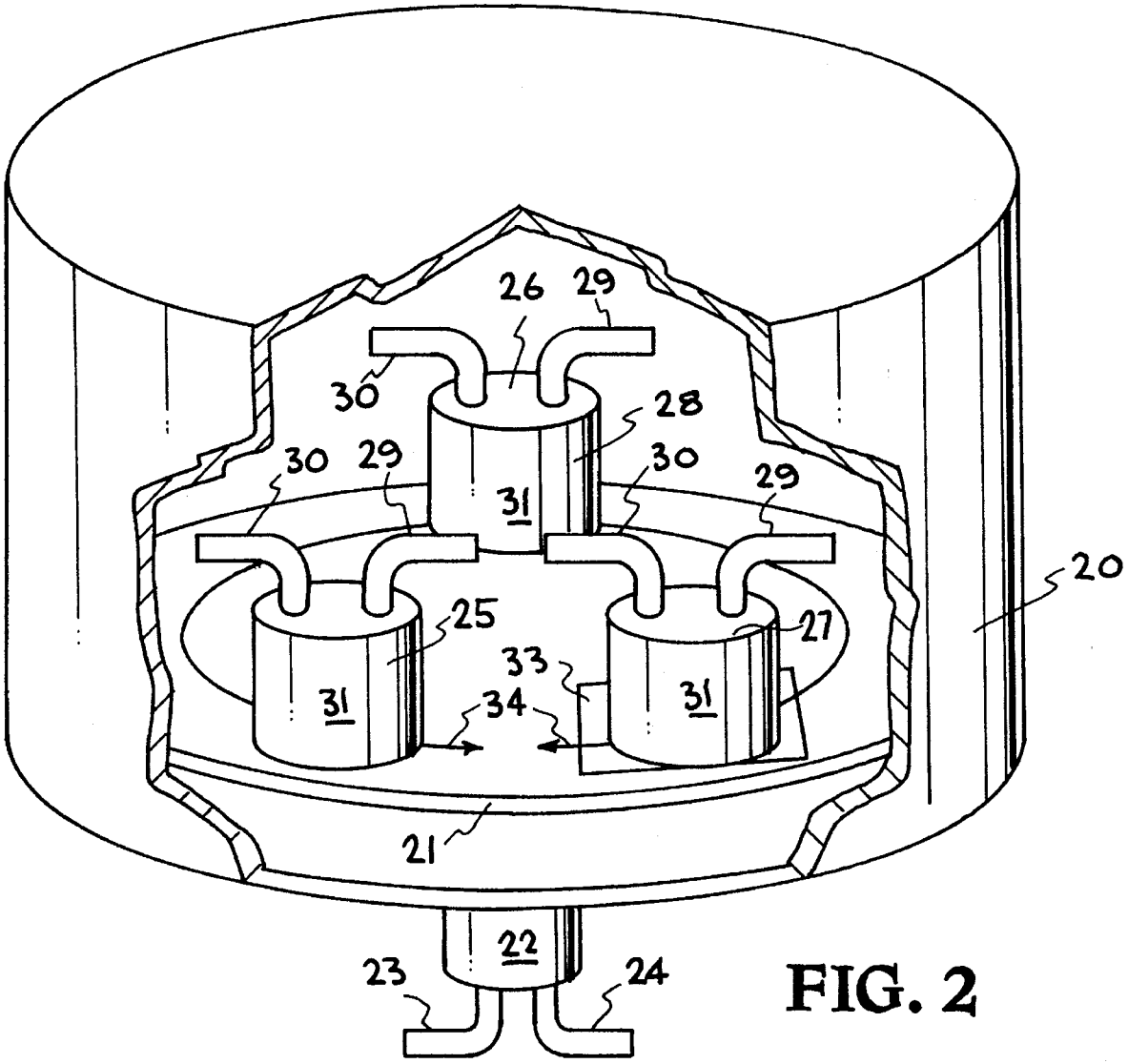
FIG. 2 is a schematic of a three source magnetron sputtering assembly.

The following sets forth an example of the fabrication method for producing the Ti—C—CuO multilayer structure of the accompanying drawing, using the magnetron sputter deposition technique:

The multilayer structure 10 is fabricated by magnetron sputter depositing thin films of Ti, C, CuO, C, Ti, C, CuO, C etc., as shown in FIG. 1, from individual magnetron sputtering sources onto a cooled surface or substrate that rotates under each source, such as illustrated in FIG. 2, described hereinafter. Magnetron sputtering is a momentum transfer process that causes atoms to be ejected from the surface of a cathode or target material by bombardment of inert gas ions accelerated from a low pressure glow discharge. Magnetron sputtering is known in the art, as exemplified by U.S. Pat. No. 5,203,977 issued Apr. 20, 1993 to D. M. Makowiecki et al. and U.S. application Ser. No. 08/005,122 filed Jan. 15, 1993, entitled "Magnetron Sputtering Source", now U.S. Pat. No. 5,333,726 issued Aug. 2, 1994, and assigned to the same assignee. Thus, a detailed description herein of a magnetron sputtering source and its operation is not deemed necessary.

The individual magnetron sources may be located and controlled such that the substrate is continuously rotated from one source to another using four (4) sources (i.e. Ti, C, CuO, SIC), or a three (3) magnetron assembly source may be used as shown in FIG. 2, wherein only one carbon target or source is used, and the substrate is rotated back and forth so as to provide sequential layers of Ti, C, CuO, Cu, Ti, C, etc.). An advantage of the three source assembly of FIG. 2 is that, the reactive metal layer and the oxide layer may be composed of two thin films due to the substrate rotating in opposite directions under the source, as seen with respect to FIG. 2.

Referring now to FIG. 2, a three source magnetron sputtering assembly is schematically illustrated, and which comprises a chamber 20 in which is located a rotating copper substrate table 21 provided with a substrate water cooling mechanism 22 having coolant inlet and outlets 23 and 24. Located and fixedly mounted above the rotating table 21 are three DC magnetrons 25, 26 and 27, equally spaced at 120° C., and being electrically negative, as indicated at 28. Each of the magnetrons 25, 26 and 27 is provided with water cooling inlets 29 and outlets 30. Located between each of the magnetrons 25–27 and the rotating table 21 is a cross contamination shield 31. Rotating table 21 is provided with an opening 32 in which is located a substrate 33 on which the thin films of reactive metal, carbon and oxide are deposited as the table 21 is rotated in opposite directions over the substrate 33 as indicated by the dash line and double arrow 34. The chamber 20 may include means, not shown, for providing a desired atmosphere for the sputtering operation, the type of atmosphere depending on the materials being sputtered.

In operation of the FIG. 2 assembly, and in conjunction with the above described embodiment, Magnetron 25 is indicated as a carbon (C) source, magnetron 26 as a titanium (Ti) source, and magnetron 27 as a copper oxide (CuO) source. The table 21 is first rotated to the position shown, such that the substrate 33 is located beneath the Ti source 26 whereby a thin film (≧10 Å) 11 of titanium is sputtered onto the substrate 33. The table 21 is rotated so that the substrate 33 is located beneath the C source 25 whereby a thin film (≧10 Å) 13 of carbon is deposited on the titanium film 11 (see FIG. 1). The table 21 is then rotated so that the substrate 33 is located beneath the CuO source 27 whereby a thin film (≧10 Å) 12 of copper oxide is deposition on the carbon film 13. At this point, a second film of CuO may be deposited and/or the direction of rotation the table 21 reversed such that the substrate 33 is again positioned beneath the C source 25 for depositing a film 13 of carbon on the CuO film 12. Whereafter, the table is rotated such that substrate 33 is beneath Ti source 26, then back to the C source 25, then to the CuO source 27, then to C source 25, and so on until the desired number of layers of reactive metal, carbon and oxide are deposited on the substrate 33. After completion of the formation of the various layers on the substrate 33, the substrate may be removed, if desired, by polishing, etching, etc. as known in the art, to produce embodiment illustrated in FIG. 1.

While the above-exemplified fabrication process involved a Ti—C—CuO multilayer structure, the same sequence of steps using different magnetron sputter process parameters, can be utilized to produce multilayer structures from other metal-carbon-oxide combinations, such as Al—C—CuO and Be—C—CuO, for example.

It has thus been shown that the present invention provides a new type of explosive consisting of an organic component, such as carbon, inorganic elements or reactive metals, and inorganic oxides. Unlike organic explosive molecules, this explosive has properties that can be engineered because the structure is a fabricated multilayer not determined by molecular structure and bonding. It provides an alternative to any application for organic propellants or explosives. The stability of inorganic materials from which the new type explosive consists make it attractive for use in severe environments such a space applications. Also, the multilayer structure can be engineered to provide desired ignition temperatures and detonation characteristics. For example, the multilayer explosive can be engineered to be ignited by a mechanical scratch at room temperature, or to be as insensitive to ignition as a mixture of powder components. In addition, the ability to control the thickness (from 10 to 10,000 angstroms) of the various layers in the multilayer structure provide control over ignition sensitivity. Thicker layers in the multilayer structure produce a more stable material. In addition to beryllium, aluminum, and titanium, other inorganic elements or reactive metals such as lithium (Li), calcium (Ca), zirconium (Zr), and yttrium (Y), may be used. Also, the inorganic oxides of other metals, such as gallium (Ga), zinc (Zn), nickle (Ni), cobalt (Co), molybdenium (Mo), tin (Sn), and germanium (Ge) may be used. While carbon is the preferred organic component layer between the reactive layer and the oxide layer, other organic components (i.e. polymer films) which will react with both but also prevents any passivating reaction between the reactive material and the inorganic oxide material, may be used. Experimental verification thus far has only involved the use of carbon, as the organic separation layer or component.

While a particular embodiment of the invention has been illustrated and described, and specific materials, thicknesses, and processing procedures have been set forth to explain the principles of the invention, such are not intended to be limiting. Modifications and changes will become apparent to those skilled in the art, and it is intended that the invention be limited only by the scope of the appended claims.

I claim:

1. A multilayer explosive consisting of layers of an organic material, reactive material, and an inorganic oxide, with a layer of the organic material between layers of the reactive material and inorganic oxide;

said organic material normally functioning to prevent reaction between said reactive material and said inorganic oxide; and wherein upon ignition said organic material enters into a reaction with said reactive material and said inorganic oxide.

2. The explosive of claim 1, wherein the organic material is carbon.

3. The explosive of claim 1, wherein the reactive material is a metal selected from the group of titanium, beryllium, aluminum, lithium, calcium, zirconium and yttrium.

4. The explosive of claim 1, wherein the inorganic oxide is selected from the group consisting of copper oxide, gallium oxide, zinc oxide, molybdenum oxide, nickle oxide, cobalt oxide, tin oxide and germanium oxide.

5. The explosive of claim 1, wherein the organic material is carbon, the reactive material is a light metal selected from aluminum, beryllium, and titanium; and the inorganic oxide is a copper oxide.

6. The explosive of claim 1, wherein the layers of the organic material, the reactive material, and the inorganic oxide, each have a thickness in the range of 10 to 10,000 angstroms.

7. The explosive of claim 1, comprising a plurality of each of the layers of the organic material, the reactive material, and the inorganic oxide.

8. The explosive of claim 1, wherein the organic material is carbon, the reactive material is titanium, and the inorganic oxide is copper oxide.

9. The explosive of claim 8, comprising a plurality of each of said layers deposited one on top of the other.

10. A nanoengineered multilayer explosive, consisting of plurality layers of each of an organic material, an inorganic light metal, and an inorganic oxide, with a layer of the organic material located intermediate each of the adjacent layers inorganic light metal and inorganic oxide to prevent premature reaction therebetween.

11. The multilayer explosive of claim 10, wherein combinations of said layers are selected from the material combinations of Al—C—CuO, Be—C—CuO, and Ti—C—CuO.

12. The multilayer explosive of claim 11, wherein each of said layers has a thickness in the range of 10 to 10,000 angstroms.

13. The multilayer explosive of claim 12, wherein the material combination is Ti—C—CuO, and wherein there is one more layer of Ti than CuO.

14. The multilayer explosive of claim 10, wherein the layers of organic material is composed of carbon.

15. The multilayer explosive of claim 14, wherein the layers of inorganic oxide are composed of copper oxide.

16. The multilayer explosive of claim 10, wherein the layers of inorganic light metal are selected from the group of aluminum, beryllium, titanium, lithium, calcium, zirconium and yttrium.

17. The multilayer explosive of claim 10, wherein the inorganic oxide is selected from the group consisting of copper oxide, gallium oxide, zinc oxide, nickle oxide, cobalt oxide, molybdenum oxide, tin oxide and germanium oxide.

18. A method for fabricating a nanoengineered, multilayer explosive structure, including the steps of:

depositing a layer of an inorganic element to a thickness in the range of 10 to 10,000 angstroms;

depositing a layer of carbon on the thus deposited inorganic element layer to a thickness in the range of 10 to 10,000 angstroms;

depositing a layer of an inorganic oxide on the thus deposited layer of carbon to a thickness in the range of 10 to 10,000 angstroms;

depositing a layer of carbon on the thus deposited layer of inorganic oxide to a thickness in the range of 10 to 10,000 angstroms; and depositing a layer of an inorganic element on the thus deposited layer of carbon to a thickness in the range of 10 to 10,000 angstroms.

19. The method of claim 18, additionally including the steps of depositing additional layers of carbon, the inorganic oxide, and the inorganic element in the same sequence and thickness, so as to produce a desired overall number of each of the layers.

20. The method of claim 18, wherein the steps of depositing are carried out by magnetron sputter deposition.

21. The method of claim 20, wherein the steps of depositing are carried out utilizing multiple individual magnetron sources.

22. The method of claim 21, wherein the multilayer explosive structure is formed on a substrate that is rotated adjacent to each of the individual magnetron sources.

23. The method of claim 22, additionally including cooling the substrate.

24. The method of claim 22, wherein the steps of depositing are carried out by continuously rotating the substrate from one source to another source.

25. The method of claim 22, wherein the steps of depositing are carried out by rotating the substrate back and forth between a source containing the organic material and sources containing the reactive material and the inorganic oxide.

26. The method of claim 18, additionally including depositing the layer of an inorganic element from material selected from the group consisting of aluminum, beryllium, titanium, lithium, calcium, zirconium, and yttrium.

27. The method of claim 18, additionally including depositing to layer of an inorganic oxide from material selected from the group consisting of copper oxide, gallium oxide, zinc oxide, nickel oxide, cobalt oxide, molybdenum oxide, tin oxide, and germanium oxide.

28. The method of claim 18, additionally including depositing one more layer of the inorganic element than the inorganic oxide.

* * * * *